United States Patent [19]

Waddington

[11] Patent Number: 4,958,471

[45] Date of Patent: Sep. 25, 1990

[54] ROOF TILE SECURING MEANS

[76] Inventor: Richard Waddington, 75 Milan Terrace, Stirling, South Australia, 5152, Australia

[21] Appl. No.: 407,965

[22] Filed: Sep. 15, 1989

[30] Foreign Application Priority Data

Sep. 7, 1988 [AU] Australia ..... PJ0281

[51] Int. Cl.[5] ..... E04D 1/34

[52] U.S. Cl. ..... 52/546; 52/550; 52/551

[58] Field of Search ..... 52/551, 546, 550, 547

[56] References Cited

U.S. PATENT DOCUMENTS

| | | | |
|---|---|---|---|
| 1,023,878 | 4/1912 | Ronnau | 52/550 |
| 1,738,006 | 12/1929 | Houghton | 52/546 |
| 2,262,984 | 8/1942 | Alvarez, Jr. | 52/551 X |
| 2,648,103 | 8/1953 | Wahlfeld | 52/546 X |
| 2,664,978 | 1/1954 | Fox | 52/551 X |
| 3,261,136 | 7/1966 | Abner et al. | 52/546 X |
| 3,703,062 | 11/1972 | McKinney | 52/551 |
| 4,262,464 | 4/1981 | Ludowici | 52/552 |

FOREIGN PATENT DOCUMENTS

| | | |
|---|---|---|
| 259829 | 2/1968 | Austria . |

*Primary Examiner*—Carl D. Friedman
*Assistant Examiner*—Linda J. Hoffert
*Attorney, Agent, or Firm*—Klauber & Jackson

[57] ABSTRACT

An improved roof tile securing means for securing roof tiles to a roof structure comprising a plurality of elongate tile support battens each having an upstanding web, an upper flange extending to one side of the web, and a lower flange extending to one side of the web, the flanges being approximately parallel, securing means for securing the tile support battens to the roof structure in spaced apart parallel relationship, wherein each roof tile has an upper or head end portion supported on the upper surface of the lower flange of one tile support batten, and a lower or tail end portion which is supported by the upper flange of an adjacent lower batten, the lower or tail end portion overlapping the upper or head end portion of an adjacent lower tile. A groove or slot forming walls forming an upper flange locating groove or slot is located on the underside of the roof tile near to and facing in the direction of its lower or tail end portion. The upper flange of each batten is arranged to engage within a respective groove or slot, whereby with the upper flange so engaged, the lower or tail end portion of each tile is restrained against upward lifting movement.

11 Claims, 5 Drawing Sheets

ROOF TILE SECURING MEANS

This invention relates to an improved tile roofing system and in particular to an improved means for securing together roof tiles in the laying of same to form a tile roof.

It is well known for new tile roofs to be assembled by laying the upper end of each tile to rest directly upon a support batten while the lower end of each tile lies upon the upper or head end of one or more tiles in the next lower course. Normally some of the tiles in a roof are held down by fasteners such as, for example, a nail which is driven through a nail clearance hole near the upper or head end of the tile into the supporting batten. It is also customary for some of the tiles to be held down by means of a tie wire arranged to extend through a lug projecting downwardly from the underside of the tile and is tied around the batten supporting the upper or head end of the tile. Whether nails or tie wires are used, such hold-down devices for one tile serves also to hold down the tiles which overlap it.

It has been found however that such roof tile systems are generally not satisfactory in conditions where the roofs are subjected to extremely severe uplift wind forces, e.g. in cyclonic or tropical areas, in that if one tile is uplifted and separated from the others, normally a significant portion of the roof is also lost (i.e. a chain reaction effect). The reason for this is possibly due to the fact that existing arrangements are generally effective only to tie down the upper or head end of the tile—not the lower or tail end. Thus in the event of high wind forces on the tile, a leverage effect occurs which causes the lower or tail end of the tile to be uplifted and in turn the tie-down device being detached.

The applicant is also aware of various attempts to replace the nail and tie wire hold-down devices with securing clips. However, whilst such clips are designed to secure or hold down the tiles near their lower or tail end, the installation of the clips is both labour intensive and time-consuming and generally not favoured by roof installers. Particularly it has been found that the tiles cannot be laid without the installer having to work both outside of and within the roof space.

It is the main object of the present invention to provide an improved roof tile securing system which is effective to anchor or hold down the lower or tail end of a tile without the need for any separate hold-down or fixing member such as a clip, nail or tie wire.

It is a further object of the present invention to provide improved roof tile securing means which will allow a tile roof to be assembled simply and quickly and in a more cost effective manner than with known roof tile systems.

It is a further object of the present invention to provide an improved roof tiling system whereby tiles can be readily and securely mounted on roofing battens and, when so mounted, will be able to withstand the forces caused by gale force winds, and will not result in a portion of the roof being "lost" if in the unlikely event an individual tile should be uplifted and separated.

According to this invention therefore, there is provided improved means for securing roof tiles to a roof structure comprising a tile support batten having an upstanding web, an upper flange extending to one side of said web, and a lower flange extending to the other side of said web, the flanges being approximately parallel, said lower flange being adapted for securement to the roof structure, e.g. rafters, a roof tile having an upper or head end portion supported on the upper surface of said lower flange of one tiling batten, and a lower or tail end portion which is supported by the upper flange of an adjacent lower batten, said lower or tail end portion overlapping the upper or head end portion of an adjacent lower tile, groove or slot forming walls forming an upper flange locating groove or slot on the underside of the tile near to and facing in the direction of its lower or tail end portion, said upper flange of the batten being arranged to slidably engage within said groove or slot, whereby with the upper flange so engaged, the lower or tail end portion of the tile is restrained against upward lifting movement.

Preferably, said tile support batten is formed as an integral metal strip of approximately Z cross-sectional shape.

Preferably, the groove or slot extends continuously across the underside of the tile and lies in a plane approximately parallel to the plane of the tile.

In another preferred form of this invention, each tile is moulded with a lug formation on its underside surface which has a lug body portion parallel to and spaced from the underside surface of the tile so as to form said upper flange locating slot or groove.

In yet another preferred embodiment of the invention, each of the tiling battens is a roll formed strip of galvanised steel or other metal, the width of the upper flange being less than the width of the lower flange which is preferably secured to a roof rafter by means of fastening nails. Preferably the lower flange is provided with a raised stiffening rib formation having a flattened upper surface on which rests an underside surface portion of the upper or head end of a tile.

The interengagement of the tiles along their side margins is in accordance with known art, and the tiles are laid in a conventional manner where an upper tile is laid so as to overlap a pair of adjacent lower tiles.

Preferably, the underside of each of the tiles is approximately planar which is in marked contrast to existing tile designs. The upper surfaces of the tiles may be patterned as desired.

In order to more fully explain the applicant's invention, two embodiments are described hereunder in some further detail and with reference to the accompanying drawings, wherein.

Figure 1:
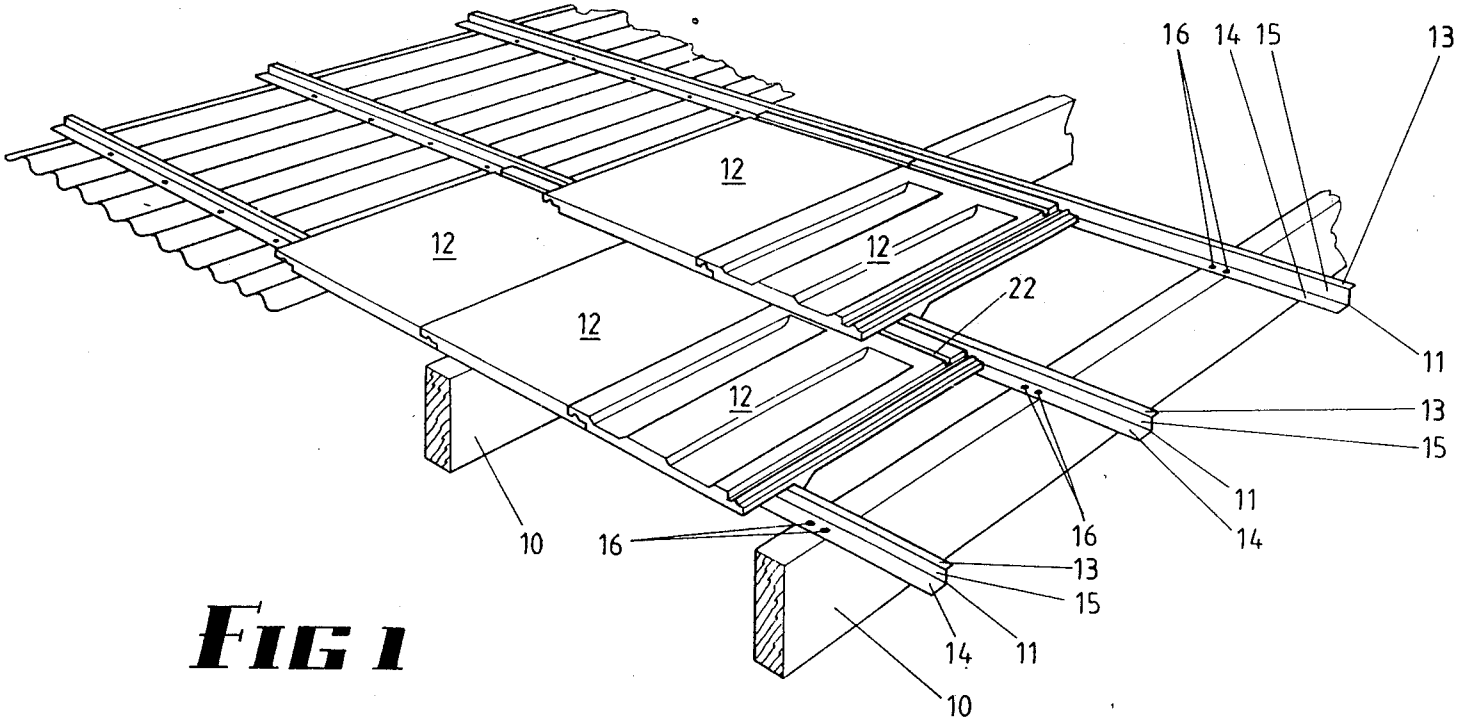
FIG. 1 is a perspective view of a roof assembly formed in accordance with one embodiment of the invention.

In the embodiment illustrated in FIGS. 1 to 5, reference is made to a roof assembly comprising timber rafters 10 on which are supported a plurality of elongate tiling battens 11 which in turn support rows of interlocked roof tiles 12 (some of which are patterned, others not), each upper tile 12 being arranged to overlap a pair of adjacent lower tiles 12 in accordance with known art. FIG. 1 shows the battens 11 secured to rafters 10 as well as to an existing iron roof where the tiles 12 are laid thereover.

Each of the tiling battens 11 is a roll formed strip of galvanised steel of approximately Z cross-sectional shape defined by an upper planar flange 13, an oppositely directed lower flange 14, and an upstanding or approximately vertical web 14 which interconnects the flanges 13, 14. In this embodiment the upper flange 13 has a width smaller than the width of the lower flange 14. The battens 11 are secured to the rafters 10 by means of nails 16 which are driven through the lower flange 14 of each of the battens 11.

Each of the tiles 12 is a rectangular shaped approximately planar moulding having a looking lug 17 projecting from the underside surface thereof near its lower or tail end. In this embodiment the looking lug 17 has a lug body portion 17' which extends approximately parallel to the underside of the tile 12 and is spaced therefrom so as to form a flange receiving groove or slot 18 which extends continuously across the underside surface of the tile 12, the width and depth of the groove or slot 18 being sufficient to snugly and slidably accommodate the upper flange 13 of a tiling batten 11 to thereby interlock the tile to the tiling batten. Preferably the end face of the lug 17, when in the interlocked condition, is contiguous with the batten web 15. It will of course be appreciated that the lug 17 need not extend continuously across the underside of the tile and may, for example, comprise a series of spaced individual lug formations on the tile underside surface.

Figure 2:
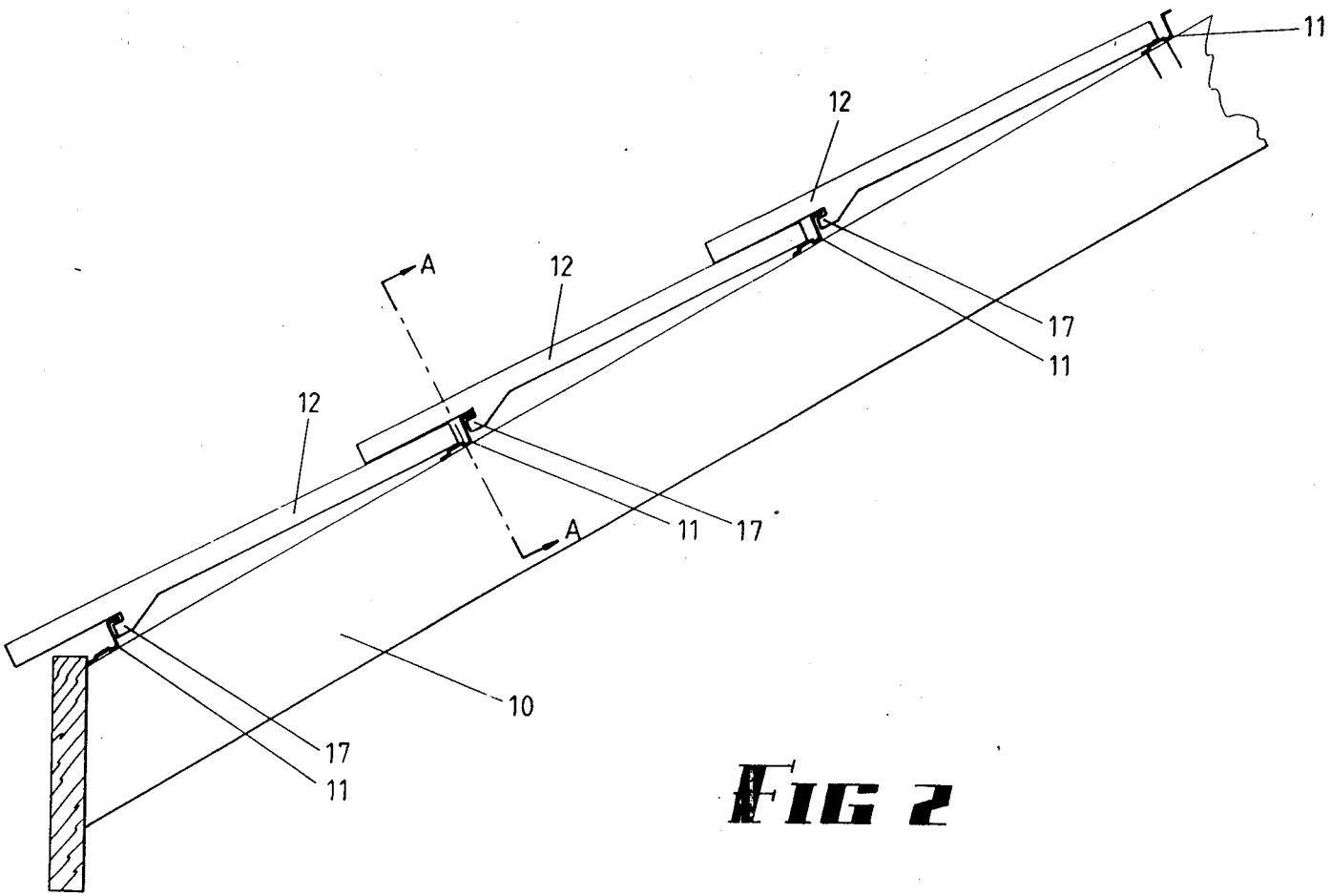
FIG. 2 is a partly sectioned side elevational view of FIG. 1.
Figure 3:
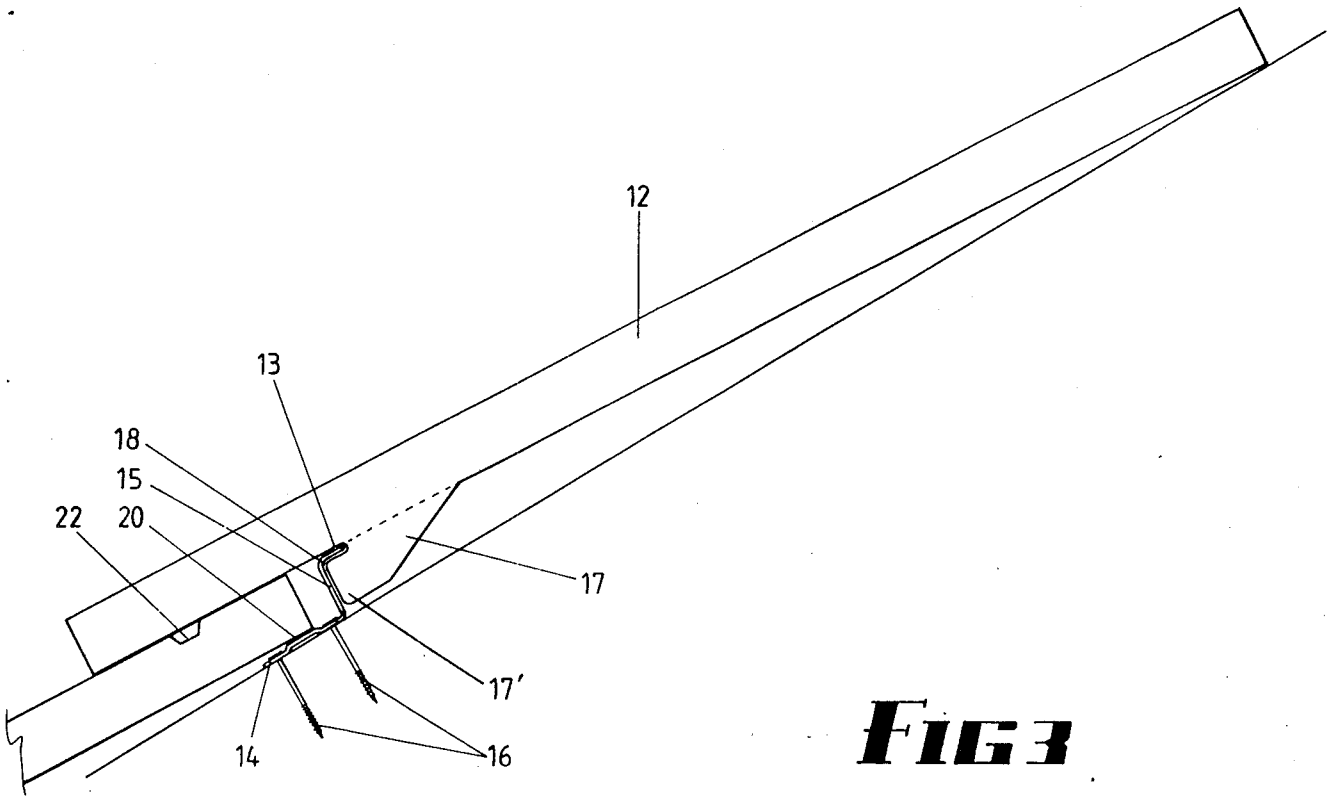
FIG. 3 is an enlarged fragmentary view similar to FIG. 2.
Figure 4:
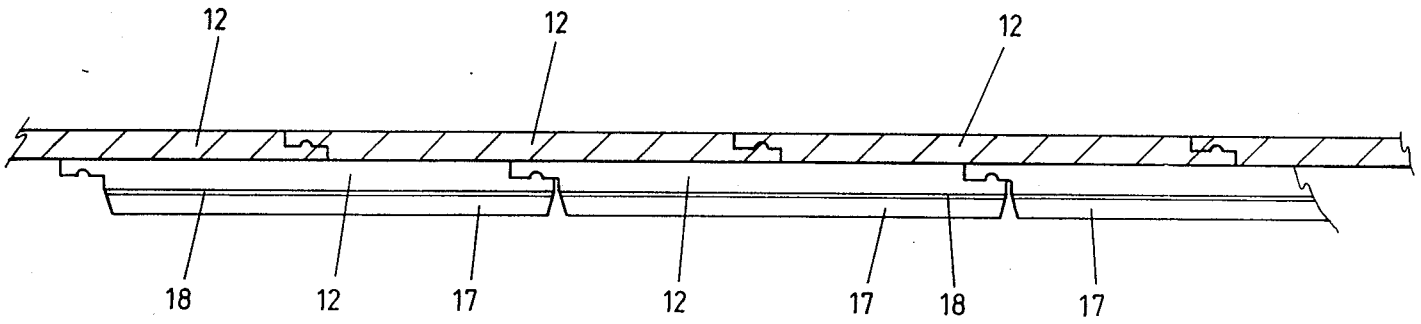
FIG. 4 is a sectional view taken along the lines A—A of FIG. 2 (omitting the batten)
Figure 5:
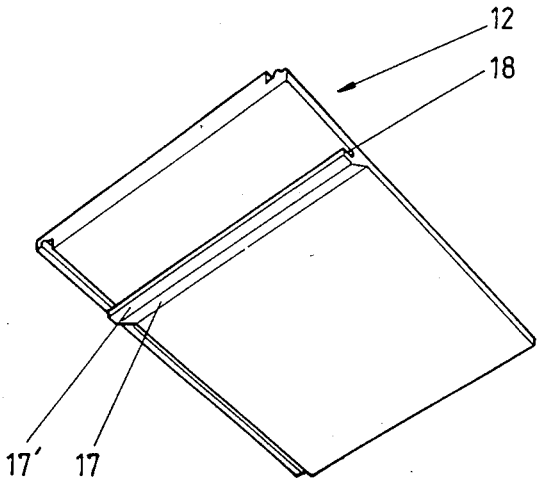
FIG. 5 is a perspective view of one of the tiles shown in FIG. 1.

As shown in FIGS. 1 to 3, each of the tiles 12 has its upper or head end portion resting on the lower flange 14 of one tiling batten 11 and its lower or tail end portion resting on the upper flange 13 of the next lower tiling batten 11 and overlapping the upper or head end portions of a pair of adjacent lower tiles 12, the upper flange 13 of the next lower tiling batten 11 lockingly engaged within the slot or groove 18 of the tile 12.

With this arrangement each tile can be simply and quickly laid in position without the need for additional tie-down devices such as nails or tie wires. The interlocking engagement between the upper flanges 13 of the battens 11 and the grooves or slots 18 on the tiles 12 effectively anchors the lower end portions of the tiles and renders the uplifting thereof, e.g. by wind forces unlikely. Of course the upper or head end portions of the tiles are effectively restrained by the overlapping portions of the adjacent higher tiles.

As shown in FIG. 3, each of the lower flanges 14 of the tiling battens 11 is provided with an approximately centrally located raised stiffening rib formation 20 extending longitudinally thereof, the rib 20 having a flattened upper surface which forms a seating surface for the upper end portion of a tile 12 which is supported thereon. The flattened upper surface is inclined with respect to the plane of the lower flange 14, the slope being in accord with the slope of the roof. The height of the rib formation 20 is designed so that the upper surface of the upper end portion of each tile is contiguous with the underside surface of an overlapping portion of an adjacent higher tile.

As also shown in FIG. 3, the upper surface of each of the tiles 12 is formed with a transversely extending groove 22 adjacent its upper end portion and which is overlapped by the lower end portions of a pair of adjacent higher tiles. The groove 22 forms a well and reduces the likelihood of any water, e g. rain, seeping between the tiles and entering the roof space.

Figure 6:
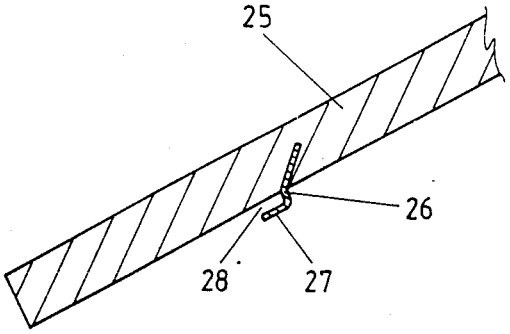
FIG. 6 is a fragmentary sectional view of a roof tile formed according to another embodiment of the invention.
Figure 7:
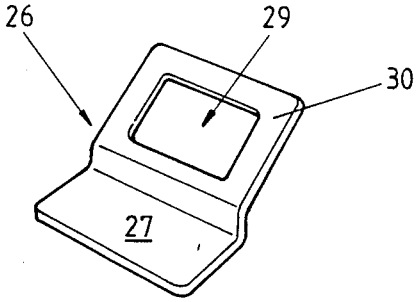
FIG. 7 is a perspective view of an anchorage plate embedded in the tile shown in FIG. 6.

In the embodiment shown in FIGS. 6 and 7, each tile 25 has embedded therewithin a plurality (preferably two) of transversely aligned anchorage plates 26 projecting from the underside of the tile 25, the plate 26 having a projecting flange 27 which together with the tile underside surface forms a locating groove or slot 28 displaced from the plane of the tile and facing in the direction of its lower end portion. The slot 28 is sized and shaped to receive the upper flange 13 of the tiling batten 11. Preferably, each tile has two such plates 26, one adjacent each side thereof. Referring to FIG. 7, each plate 26 is formed with an opening 29 in its inner flange 30 to ensure its secure anchorage in the tile during moulding thereof. The plates 26 can be formed of plate metal.

The actual laying method for the roof tiles of this invention will of course be self-evident as will the simplicity and the quickness of such method.

A brief consideration of the above-described embodiment will indicate that the invention provides for an extremely simple and effective roof tiling system wherein the roofing tiles are securely fastened in such a manner that the likelihood of their being uplifted by high velocity winds is minimal.

I claim:

1. Improved roof tile securing means for securing roof tiles to a roof structure comprising a plurality of elongate tile support battens each having an upstanding web, a thin upper flange extending to one side of said web, and a lower flange extending to the other side of said web, the flanges being approximately parallel, securing means for securing said tile support battens to the roof structure in spaced apart parallel relationship, wherein each said roof tile has an upper end portion supported on the upper surface of said lower flange of one tile support batten, and a lower end portion which is supported by the upper flange of an adjacent lower batten, said lower end portion overlapping the upper end portion of an adjacent lower tile, slot forming walls forming an upper flange locating slot on the underside of said roof tile near to and facing in the direction of its lower end portion, said upper flange of each said batten being arranged to snugly engage within a respective said slot, such that with the upper flange so engaged, the lower end portion of each tile is restrained against upward lifting movement, and the upper end portion of each tile being coplanar with the lower end portion thereof, and said upper end portion being free of any ribs thereat such that interlocking between the battens and the underside of the roof tiles occurs only at the lower end portion of the tiles.

2. Improved roof tile securing means according to claim 1 wherein the lower flange of each said tile support batten is secured to the roof structure by nails, rivets or similar fasteners.

3. Improved roof tile securing means according to claim 1 or claim 2 wherein said upper flange locating slot extends continuously across the underside of said tile.

4. Improved roof tile securing means according to claim 2 wherein said tile support batten is formed as an integral metal strip of approximately Z cross-sectional shape.

5. Improved roof tile scouring means according to claim 1 wherein each said tile has integrally formed therewith a lug formation projecting downwardly from its underside surface, said lug formation having a lug body portion parallel to and spaced from the underside surface of the tile so as to form said upper flange locating slot.

6. Improved roof tile securing means according to claim 1 wherein each said tile is provided with at least one anchorage plate embedded in the underside surface of said tile and projecting downwardly therefrom, said anchorage plate having a projecting flange extending substantially parallel to the plane of said tile and spaced therefrom so as to form said upper flange locating slot.

7. Improved roof tile securing means according to claim 6 wherein the width of the upper flange of said tile support batten is less than the width of the lower flange, the depth of said flange locating slot being dimensioned sot hat with said upper flange engaged therein, the leading edge surface of the anchorage plate is in contiguous relation with the web of the tile support batten.

8. Improved roof tile securing means according to claim 4 wherein the width of the upper flange of said tile support batten is less than the width of the lower flange, the depth of said flange locating slot being dimensioned so that with said upper engaged therein, the leading edge surface of the slot forming walls is in contiguous relation with the web of the tile support batten.

9. Improved roof tile securing means according to claim 1 wherein said lower flange is provided with a raised stiffening rib formation having a flattened upper surface, the height of said rib formation being selected so that with a roof tile supported thereon, the upper surface of the tile is in contiguous relationship with the underside surface of an overlapping portion of an adjacent higher tile.

10. Improved roof tile securing means according to claim 1 wherein each said roof tile is provided with a transversely extending groove extending across approximately the whole width of the tile in the upper surface thereof adjacent its upper end portion, the location of the groove being such that when the tile is laid in position, the groove is overlapped by the lower end portions of a pair of adjacent higher tiles, said groove inhibiting the ingress of water between the overlapped portions of the tiles into the roof space.

11. A tile roof structure comprising;

a plurality of elongate tile support battens each formed as an integral thin metal strip of approximately z cross-sectional shape defined by an upstanding web, an upper flange extending to one side of said web, and a lower flange extending to the other side of said web, the flanges being approximately parallel;

securing means for securing said tile support battens to the roof structure in mutually spaced apart parallel relationship; and a plurality of roof tiles supported in overlapping relationship on the battens, each said roof tile having an upper end portion supported on said lower flange of a respective said tile support batten, and a lower end portion supported on the upper flange of an adjacent lower said batten, said lower end portion overlapping the upper end portion of an adjacent lower tile, each said tile being provided with slot forming walls forming an upper flange locating slot on its underside near to and facing in the direction of its lower end portion, said upper flange of each said batten being arranged to snugly engage within a respective said slot such that, with the upper flange so engaged, the lower end portion of each tile is restrained against any upward lifting movement, and the upper end portion of each tile being coplanar with the lower end portion thereof, and said upper end portion being free of any ribs thereat such that interlocking between the battens and the underside of the roof tiles occurs only at the lower end portion of the tiles.

* * * * *